US007107702B1

(12) United States Patent
Chavez

(10) Patent No.: US 7,107,702 B1
(45) Date of Patent: Sep. 19, 2006

(54) WATER SHOES

(76) Inventor: Maribel Chavez, 9947 Tangelo Ave., Bloomington, CA (US) 92316

( * ) Notice: Subject to any disclaimer, the term of this patent is extended or adjusted under 35 U.S.C. 154(b) by 0 days.

(21) Appl. No.: 10/463,450

(22) Filed: Jun. 17, 2003

(51) Int. Cl.
*A43B 7/06* (2006.01)

(52) U.S. Cl. ..... 36/3 B; 36/36 R

(58) Field of Classification Search ..... 36/3 R, 36/3 B, 3 A
See application file for complete search history.

(56) References Cited

U.S. PATENT DOCUMENTS

| | | | | | |
|---|---|---|---|---|---|
| 1,518,062 | A * | 12/1924 | Glancy | 36/8.1 |
| 1,537,778 | A * | 5/1925 | Nyhagen | 36/7.3 |
| 1,724,450 | A * | 8/1929 | Callahan | 36/3 A |
| 2,403,447 | A | 7/1946 | Browne | |
| 4,602,441 | A * | 7/1986 | El Sakkaf | 36/3 R |
| 4,888,887 | A * | 12/1989 | Solow | 36/3 R |
| 5,515,622 | A * | 5/1996 | Lee | 36/3 R |
| 5,617,585 | A | 4/1997 | Fons et al. | |
| 5,771,610 | A * | 6/1998 | McDonald | 36/116 |
| 5,813,140 | A * | 9/1998 | Obeid | 36/3 R |
| 5,935,671 | A | 8/1999 | Lhuillier | |
| 6,408,540 | B1 * | 6/2002 | DeKalb et al. | 36/8.1 |
| 2001/0025432 | A1 * | 10/2001 | Contreras et al. | 36/3 R |

* cited by examiner

*Primary Examiner*—Ted Kavanaugh

(57) ABSTRACT

A water shoes for improving the safety of public bathing and swimming areas. The water shoes includes comprises a sole portion, and upper portion including vamp and quarters, and a cuff portion for abutting an ankle of the user.

11 Claims, 4 Drawing Sheets

WATER SHOES

BACKGROUND OF THE INVENTION

1. Field of the Invention

The present invention relates to footwear and more particularly pertains to a new water shoes for protecting the feet of a user while standing in water.

2. Description of the Prior Art

The use of water related footwear is known in the prior art. U.S. Pat. No. 5,617,585 describes a rubber soled sock for protecting a user form sharp objects. Another type of water related footwear is U.S. Pat. No. 2,403,477 for use with diving suits.

While these devices fulfill their respective, particular objectives and requirements, the need remains for a device that is superior for use in public bathing and swimming facilities to help minimize injury and or infection.

SUMMARY OF THE INVENTION

The present invention meets the needs presented above by providing a protective sole, and water outlet valve for minimizing water building up in the shoe.

Another object of the present invention is to provide a new water shoes that can be easily worn in public bathing facilities to minimize the likelihood of slipping.

Still another object of the present invention is to provide a new water shoes that allows water circulation through the shoe not just accumulation in the shoe.

To this end, the present invention generally comprises a sole portion, and upper portion including vamp and quarters, and a cuff portion for abutting an ankle of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
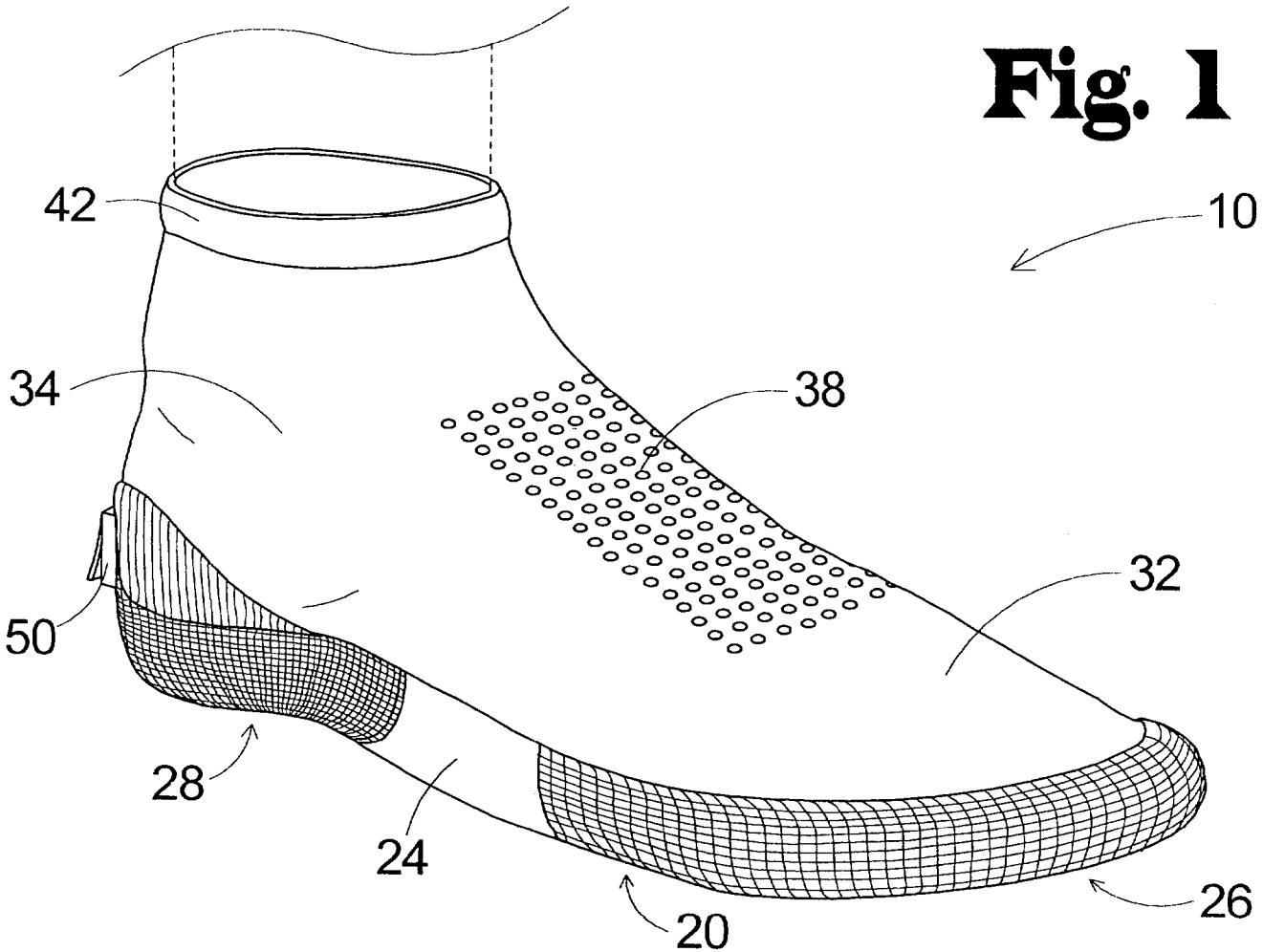
FIG. 1 is a schematic perspective view of a new water shoes according to the present invention.
Figure 2:
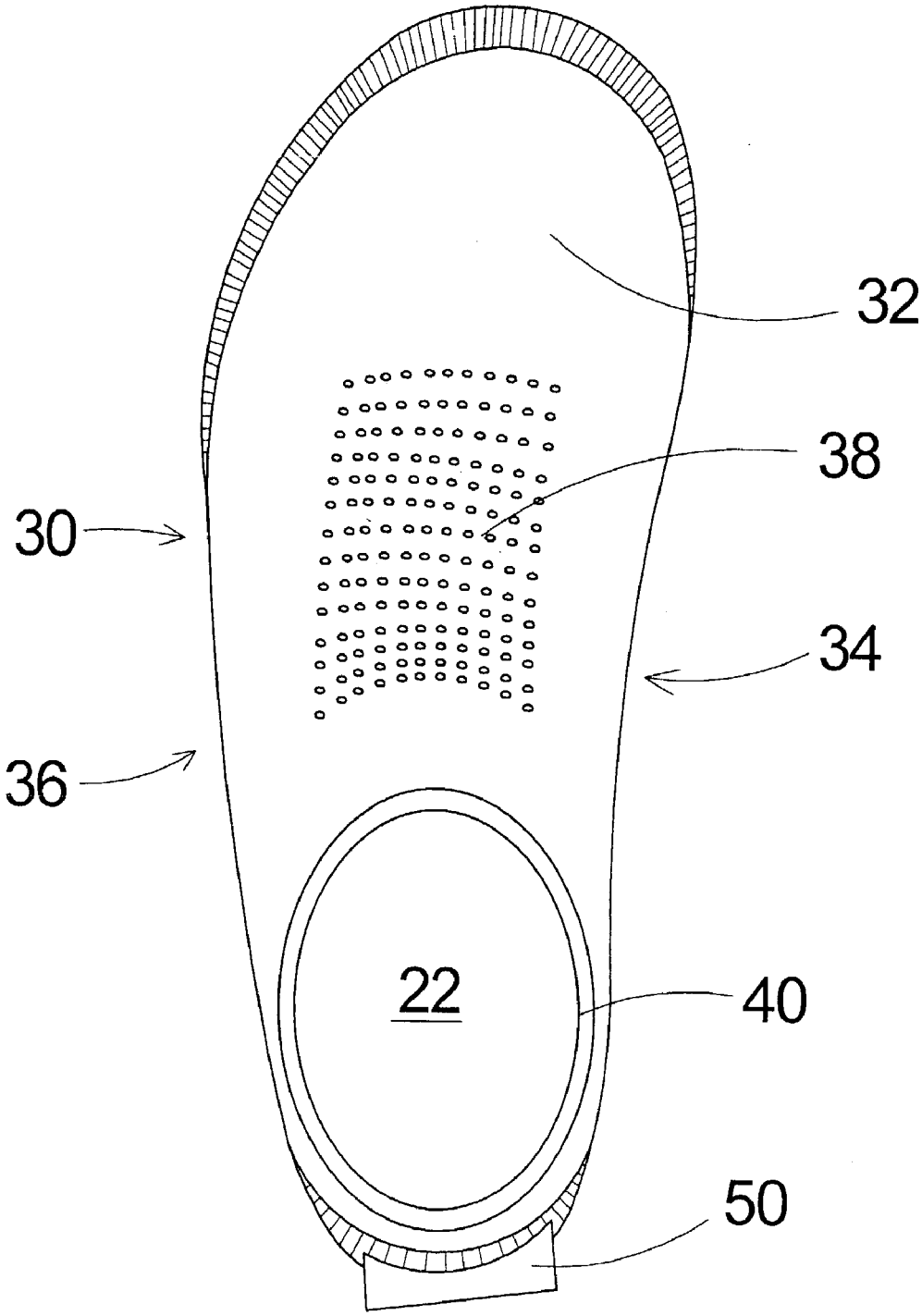
FIG. 2 is a schematic top view of the present invention.
Figure 3:
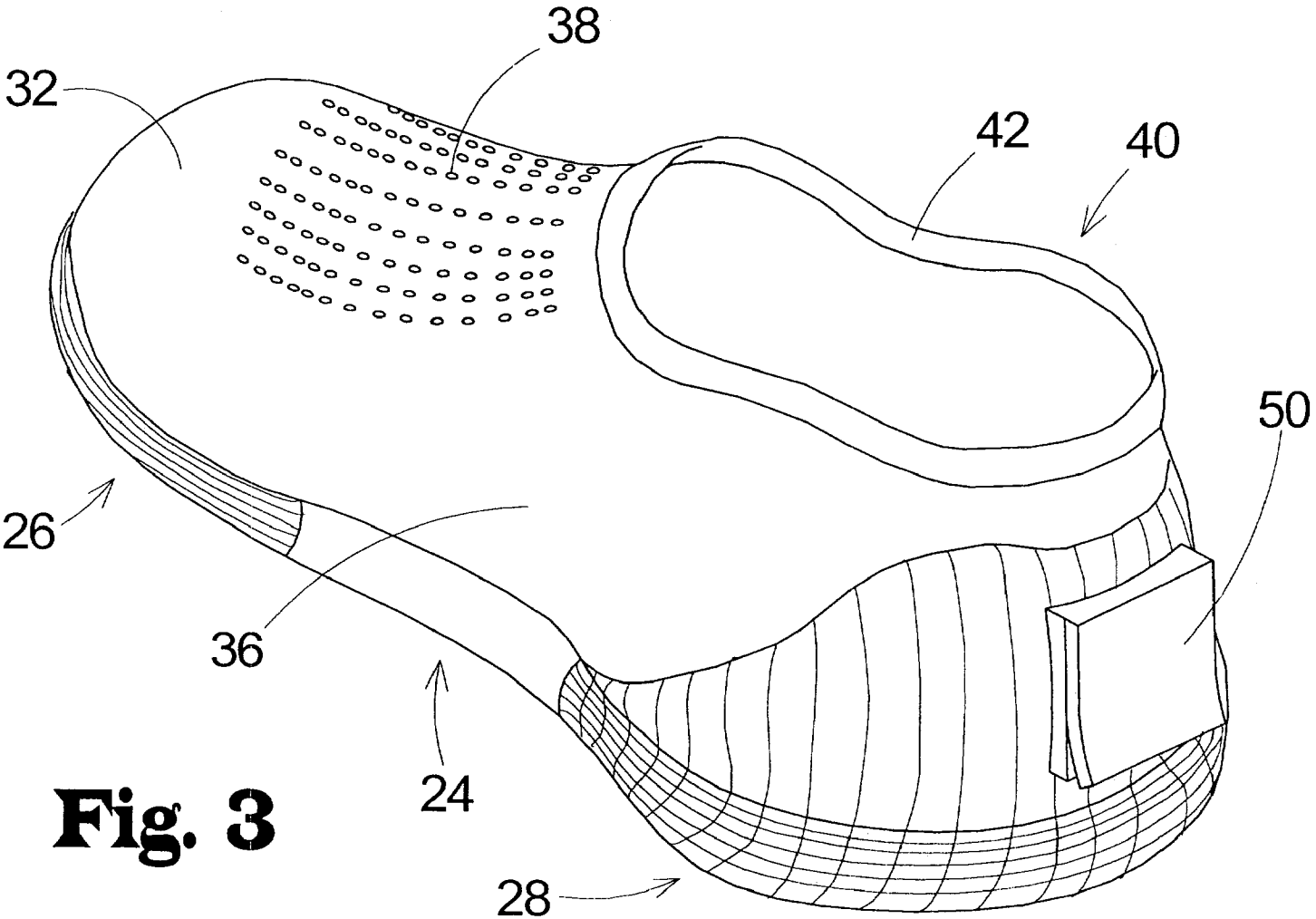
FIG. 3 is a schematic back view of the present invention.
Figure 4:
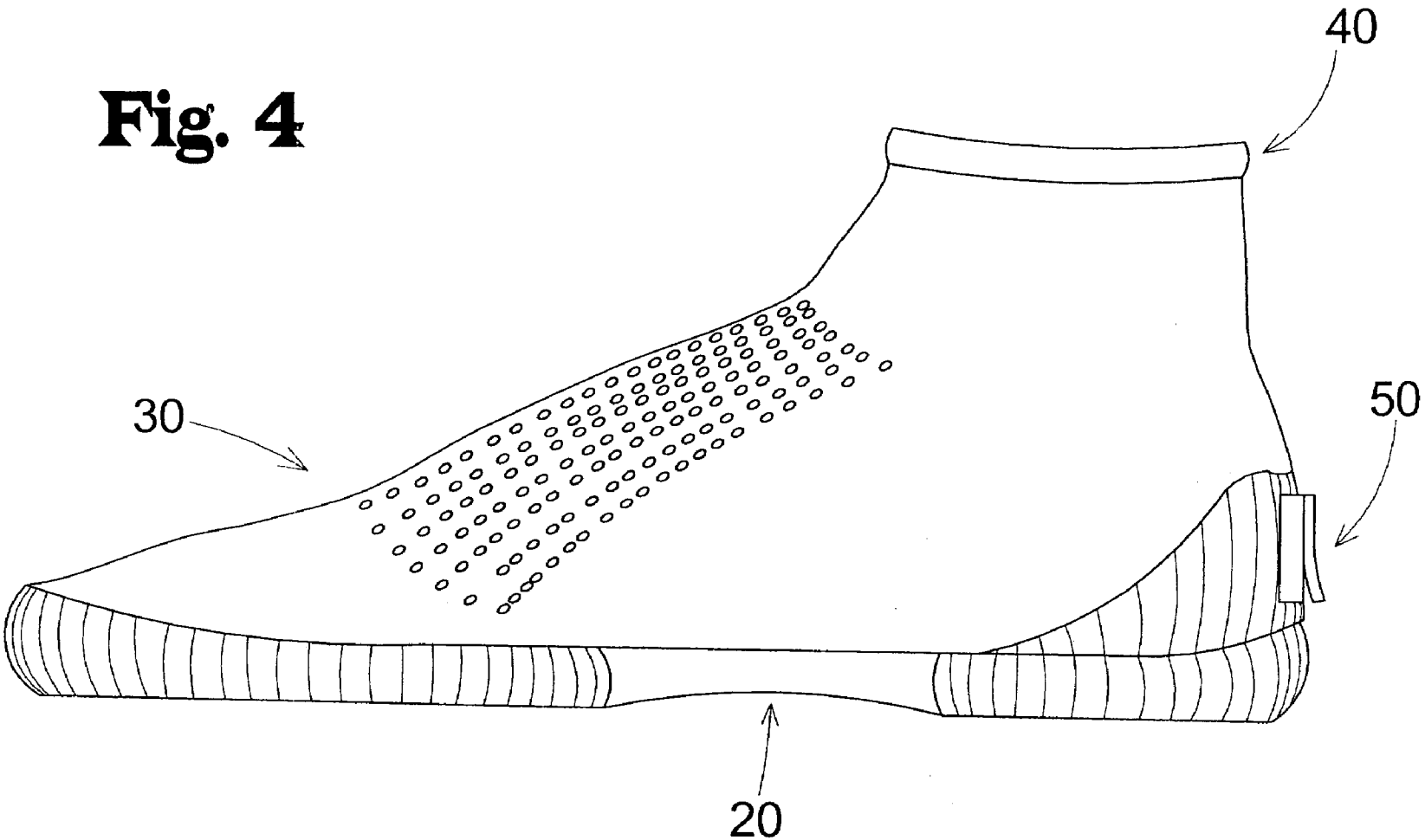
FIG. 4 is a schematic side view of the present invention.

With reference now to the drawings, and in particular to FIGS. 1 through 4 thereof, a new water shoe embodying the principles and concepts of the present invention and generally designated by the reference numeral 10 will be described.

As best illustrated in FIGS. 1 through 4, the water shoe 10 generally comprises a sole portion 20, an upper portion 30, and a cuff portion 40.

The sole portion 20 has an inner surface22 and an outer surface 24. The inner surface 22 is designed for receiving a sole of a user's foot. The outer surface 24 is designed for abutting a support surface.

In an embodiment, a tread section 26 is positioned on the outer surface 24 adjacent to a ball portion of the user's foot. The tread section 26 provides a slip resistant surface.

In a further embodiment, a second tread section 28 is similarly positioned on the outer surface 24 adjacent to a heel portion of the user's foot. The second tread section 28 also provides a slip resistant surface.

The upper portion 30 includes a vamp 32 and quarters 34,36.

The upper portion 30 is coupled to the sole portion 20.

The cuff portion 40 is coupled to the upper portion 30. Preferably the cuff portion 40 is resiliently flexible to facilitate insertion and removal of the user's foot from the shoe 10.

A plurality of apertures 38 extends through the upper portion 30 for facilitating circulation of water into the shoe 10.

An outlet flow valve 50 may be positioned through a heel section of the upper 30. The outlet flow valve 50 facilitates evacuation of water from the shoe 10.

An elastic member 42 may be operationally coupled to the cuff portion 40. The elastic member 42 facilitates the cuff portion 40 abutting an ankle of the user.

In an embodiment, the shoe 10 is made of a polymeric material.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shoe for use in and around water comprising:

a sole portion having an inner surface and an outer surface, said inner surface being adapted for receiving a sole of a user's foot, said outer surface being adapted for abutting a support surface;

an upper portion including vamp and quarters, said upper portion being coupled to said sole portion;

a cuff portion coupled to said upper portion, said cuff portion being resiliently flexible;

an outlet flow valve positioned through a heel section of said upper, said outlet flow valve facilitating evacuation of water from said shoe, said outlet flow valve being substantially aligned with an Achilles tendon of the user's foot; and wherein said upper portion includes a plurality of apertures extending therethrough for facilitating circulation of water into said shoe, said plurality of apertures being positioned in said vamp.

2. The shoe of claim 1, wherein said sole portion further comprises a tread section positioned on said outer surface adjacent to a ball portion of the user's foot, said tread section providing a slip resistant surface.

3. The shoe of claim 1, wherein said sole portion further comprises a second tread section positioned on said outer surface adjacent to a heel portion of the user's foot, said second tread section providing a slip resistant surface.

4. The shoe of claim 1, further comprising an elastic member operationally coupled to said cuff portion, said elastic member facilitating said cuff portion abutting an ankle of the user.

5. The shoe of claim 1, wherein said shoe comprises a polymeric material.

6. The shoe of claim 1, further comprising an elastic member operationally coupled to said cuff portion, said elastic member facilitating said cuff portion abutting an ankle of the user.

7. A shoe for use in and around water comprising:

a sole portion having an inner surface and an outer surface, said inner surface being adapted for receiving a sole of a user's foot, said outer surface being adapted for abutting a support surface;

an upper portion including vamp and quarters, said upper portion being coupled to said sole portion;

a cuff portion coupled to said upper portion, said cuff portion being resiliently flexible;

a tread section positioned on said outer surface adjacent to a ball portion of the user's foot, said tread section providing a slip resistant surface;

a second tread section positioned on said outer surface adjacent to a heel portion of the user's foot, said second tread section providing a slip resistant surface;

a plurality of apertures extending through said upper portion for facilitating circulation of water into said shoe, said plurality of apertures being positioned in said vamp;

an outlet flow valve positioned through a heel section of said upper, said outlet flow valve facilitating evacuation of water from said shoe;

an elastic member operationally coupled to said cuff portion, said elastic member facilitating said cuff portion abutting an ankle of the user; and wherein said shoe comprises a polymeric material.

8. A shoe for use in and around water comprising:

a sole portion having an inner surface and an outer surface, said inner surface being adapted for receiving a sole of a user's foot, said outer surface being adapted for abutting a support surface;

an upper portion including vamp and quarters, said upper portion being coupled to said sole portion;

a cuff portion coupled to said upper portion, said cuff portion being resiliently flexible;

comprising an outlet flow valve positioned through a counter section of said upper at the back of the shoe, said outlet flow valve facilitating evacuation of water from said shoe; and wherein said upper portion includes a plurality of apertures extending therethrough for facilitating circulation of water into said shoe, said plurality of apertures being positioned in said vamp.

9. The shoe of claim 8, wherein said sole portion further comprises a tread section positioned on said outer surface adjacent to a ball portion of the user's foot, said tread section providing a slip resistant surface.

10. The shoe of claim 8, wherein said sole portion further comprises a second tread section positioned on said outer surface adjacent to a heel portion of the user's foot, said second tread section providing a slip resistant surface.

11. The shoe of claim 8, wherein said shoe comprises a polymeric material.

* * * * *